US006640667B1

(12) United States Patent
Pomerantz

(10) Patent No.: US 6,640,667 B1
(45) Date of Patent: Nov. 4, 2003

(54) TOOL FOR EXTENDING THE REACH OF A PERSON

(75) Inventor: Jay Pomerantz, Huntington Beach, CA (US)

(73) Assignee: Jay Leslie, Inc., Huntington Beach, CA (US)

( * ) Notice: Subject to any disclaimer, the term of this patent is extended or adjusted under 35 U.S.C. 154(b) by 0 days.

(21) Appl. No.: 10/082,044

(22) Filed: Feb. 20, 2002

(51) Int. Cl.[7] ..... B25B 23/10; H01K 3/32
(52) U.S. Cl. ..... 81/53.12; 81/53.1
(58) Field of Search ..... 81/53.12, 53.1, 81/53.11

(56) References Cited

U.S. PATENT DOCUMENTS

| | | | | | |
|---|---|---|---|---|---|
| 636,229 | A | * | 10/1899 | Simms | 81/53.12 |
| 675,640 | A | * | 6/1901 | Renard | 81/53.12 |
| 1,067,899 | A | * | 7/1913 | Craig | 81/53.12 |
| 1,128,453 | A | * | 2/1915 | Johnson | 81/53.12 |
| 1,193,685 | A | * | 8/1916 | Harvey | 81/53.12 |
| 1,210,835 | A | * | 1/1917 | Price | 81/53.12 |
| 1,267,009 | A | * | 5/1918 | Stearn | 81/53.12 |
| 1,366,296 | A | * | 1/1921 | Swider | 81/53.12 |
| 1,540,142 | A | * | 6/1925 | Pierpoint | 81/53.12 |
| 1,540,143 | A | * | 6/1925 | Pierpoint | 81/53.12 |
| 1,601,877 | A | * | 10/1926 | Nilsson et al. | 81/53.12 |
| 1,619,559 | A | * | 3/1927 | Berry et al. | 81/53.12 |
| 1,752,737 | A | * | 4/1930 | Grinnell | 81/53.12 |
| 1,847,953 | A | * | 3/1932 | Finesey | 81/53.12 |
| 1,926,948 | A | * | 9/1933 | Iffland | 81/53.12 |
| 2,473,008 | A | * | 6/1949 | Chadsey | 81/53.12 |
| 2,573,002 | A | * | 10/1951 | Foster | 81/53.12 |
| 2,658,787 | A | * | 11/1953 | Ziese | 81/53.12 |
| 2,819,922 | A | * | 1/1958 | Panzica | 81/53.11 |
| 2,822,205 | A | * | 2/1958 | Bowie | 81/53.12 |
| 2,855,238 | A | * | 10/1958 | Ford | 81/53.12 |
| 3,069,195 | A | * | 12/1962 | Buck | 81/53.12 |
| 3,111,049 | A | * | 11/1963 | Brehmer | 81/57.26 |
| 3,232,658 | A | * | 2/1966 | Clapp | 81/53.11 |
| 4,212,577 | A | * | 7/1980 | Swanson | 414/23 |
| 4,919,019 | A | * | 4/1990 | Unger et al. | 81/53.12 |
| 5,436,526 | A | * | 7/1995 | Hohaus et al. | 313/51 |
| 5,692,417 | A | * | 12/1997 | Irpino | 81/53.12 |

* cited by examiner

*Primary Examiner*—Joseph J. Hail, III
*Assistant Examiner*—David B. Thomas
(74) *Attorney, Agent, or Firm*—Drummond & Duckworth

(57) ABSTRACT

A tool for extending the reach of a person is provided. The tool includes an elongate arm having a proximal extremity and a distal extremity. The tool includes a jaws assembly attached to the arm's distal extremity, and a controller assembly attached to the arm's proximal extremity. The jaws assembly includes a plurality of rotating jaws which are capable of being controllably forced inward or outward for grappling and releasing objects. The controller assembly includes a rotating handle having a lever. Rotation of the handle causes the jaws assembly to rotate. Meanwhile, manipulation of the lever causes the jaws to be forced inward or outward.

3 Claims, 5 Drawing Sheets

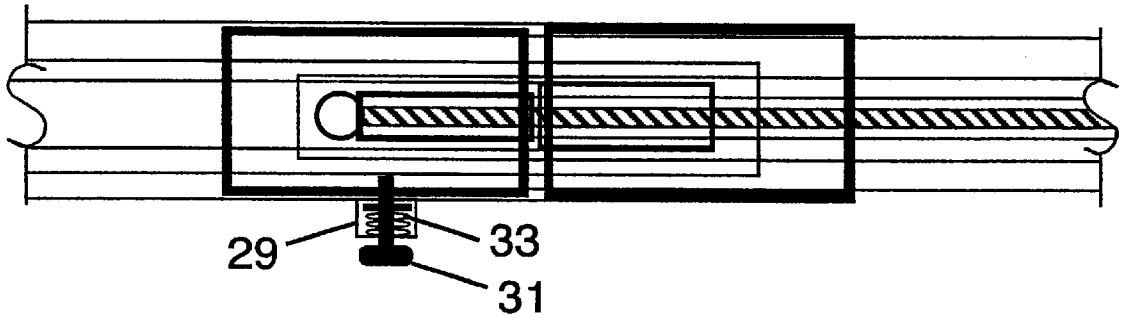
Fig.5
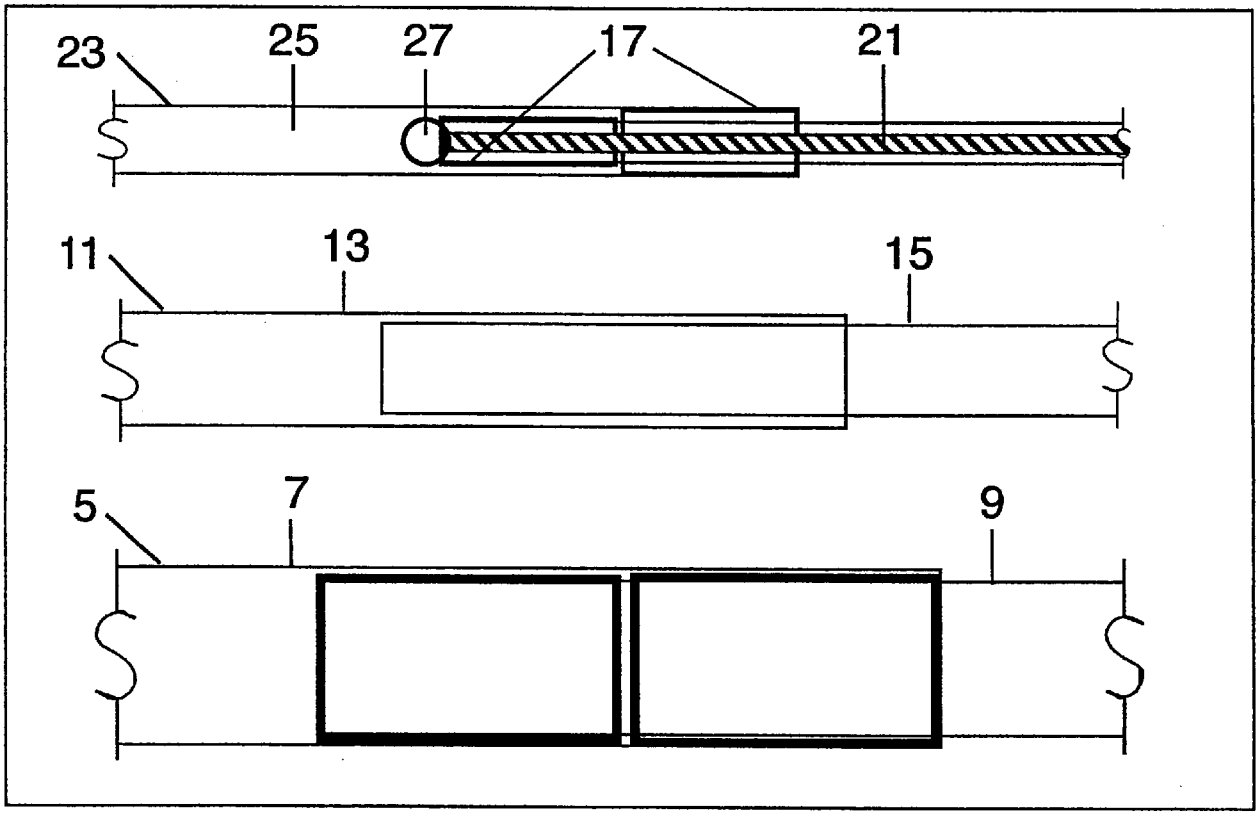
Fig. 6
Fig.7
Fig.8

TOOL FOR EXTENDING THE REACH OF A PERSON

BACKGROUND OF THE INVENTION

The present invention relates to tools for extending the reach of the tool's user. The tool may be used in connection with any task wherein an individual wishes to extend their reach. However, the present invention is described herein for use in unlocking and opening locked doors and gates.

Various tasks require that the operator extend his reach beyond arm's length. As but one example, locked gates require a person to unlock the door or gate, or reach over or under the gate to reach the gate's inside knob. Solutions to unlocking the doorknob include hiring a locksmith to "pick" the locking mechanism of the doorknob. Lock picking requires a great deal of practice, knowledge of the locking cylinders, and considerable amount of time to be successful. An additional method of entry requires using an electric drill to destroy the doorknob's lock assembly. This method of unlocking a door also requires a considerable amount of time.

Still an additional method for unlocking doorknobs requires the use of a tool which slides under the door or gate, or over the door or gate. For example, U.S. Pat. No. 5,540,121discloses a door opening tool which includes an arm having a cup rotatably attached to one of the arm's extremities. The cup is collapsible so as to receive and affix a doorknob. In operation, the tool's arm and cup are slid under a door and manipulated so that the cup receives the doorknob. A cord attached to the cup is pulled so as to retract over the doorknob and rotate the doorknob so as to open the door. Similarly, U.S. Pat. No. 5,123,307 discloses an apparatus for opening a locked door. The apparatus includes a bent rod and a gripper pad affixed to the end of a cord. In operation, the rod is manipulated under a door so as to position the gripper pad upon a doorknob. Pulling the cord causes the gripper pad to retract over the doorknob and rotate the doorknob to open the door. Unfortunately, each of the aforementioned devices are constructed for rotating common "knob" type doorknobs, but are not capable of affixing and rotating "lever" type door handles.

There are numerous additional devices for extending the reach of a person. For example, U.S. Pat. No. 1,601,877 describes a device for inserting and removing lightbulbs. The device includes a plurality of jaws sized to receive the bulb of a lightbulb. One of the jaws moves so as to provide a grip upon the lightbulb. The device also includes a mechanical linkage and gearing system which causes the jaws to rotate. Meanwhile, U.S. Pat. No. 5,692,417 and U.S. Pat. No. 1,601,877 also describe devices for inserting and removing lightbulbs from a light socket. The devices include gripping jaws. However, the devices do not include means for forcing the gripping jaws inward or outward so as to be suitable for grasping a doorknob.

Thus, there is a need for a tool for unlocking and opening locked doors and gates. It would be desirable if the device could open locked doors and gates without the necessity for incurring damage to the door or to the lock, and without the time and expense required to hire a locksmith to pick the lock. It would also be desirable if the device were capable of opening doors and gates having doorknobs of different sizes and shapes including doors having knob and lever type doorknobs.

SUMMARY OF THE INVENTION

Briefly, and in general terms, the present invention addresses the aforementioned disadvantages by providing a tool which extends the reach of a person. The tool is particularly suited for assisting persons in reaching through or over locked gates or doors to unlock the gate or door.

The tool of the present invention includes an elongate arm having a proximal extremity and a distal extremity. Attached to the distal extremity of the arm is a rotating jaws assembly. The jaws assembly includes a plurality of jaws pivotally mounted to a housing which rotate relative to the tool's arm. The jaws assembly includes a movable piston, or cam type member, which engages the jaws so as to cause them to pivotally move inward and outward for grabbing and releasing objects. Moreover, the jaws assembly may include any number of jaws, though four is considered preferable for most functions. Preferably, all of the jaws are movable inward and outward. However, the invention is also intended to encompass tools which incorporate a jaws assembly wherein one or more of the jaws are fixed, as long as the jaws assembly includes at least two or more jaws which move inward and outward for grappling objects.

The jaws assembly rotates relative to the tool's arm. The jaws assembly and jaws may be affixed to the arm so as to project outwardly from the distal extremity of the arm so as to rotate about the arm's longitudinal axis. However, in an embodiment best suited for opening doors and gates, the tool includes a rotating jaws assembly which extends from the distal extremity of the tool's arm substantially perpendicular to the arm's longitudinal axis.

The tool further includes a controller assembly affixed to the proximal extremity of the arm. The controller assembly includes a first "rotation" controller for controlling the rotation of the jaws assembly. The controller assembly further includes a second "grappling" controller for controlling inward and outward movement of the jaws for the purpose of grappling or otherwise releasing objects. In a preferred embodiment, the controller assembly is constructed in the form of a handle extending from the proximal extremity of the arm. The handle may extend proximally along the longitudinal axis of the arm. However, in the preferred embodiments of the invention, the handle projects perpendicular to the longitudinal axis of the tool's arm, parallel to the direction in which the jaws assembly extends. For this embodiment, rotation of the handle causes the jaws assembly to rotate.

In a preferred construction of the invention, the tool's arm includes a fixed outer tube, which is hollow along its entire length. Within the hollow outer tube is concentrically positioned an inner elongate rotating member. The inner rotating member connects to both the jaws assembly and the handle by gears or the like to transmit rotation from the handle to the jaws assembly. The gears may include bevel gears. Alternatively, springs, universal joints or other mechanical connections may be used to transmit rotation.

Meanwhile, a preferred embodiment of the grappling controller includes a lever affixed to the handle. Extending from the lever to the jaws assembly is a force transmitting member, referred to herein as a tension member. The tension member may be constructed in various forms, such as cord and/or rod constructions, as can be determined by one skilled in the art.

The tension member engages the lever and piston at the tension member's proximal and distal extremities, respectively. In operation, movement of the lever causes movement of the tension member, which in turn moves the piston. Accordingly, inward and outward movement of the jaws can be controlled by movement of the lever to controllably open and close the jaws for grabbing and releasing of objects. The tension member may extend exterior to the outer fixed tube. However, preferably, the tension member is positioned to extend within a hollow region formed within the inner rotating tube The tool of the present invention may be constructed of various materials including but not limited to metals and plastics. However, it is preferred that the tool primarily be constructed of lightweight metals including aluminum to provide durability. In addition, the tool's arm may be constructed of various lengths, and may even be extendable and retractable, depending on the tasks to which the tool is to be used. For opening doors and gates, it is preferred that the tool have an overall length of approximately 3–4 feet.

It is thus an object of the invention to provide a tool which is easy to use and inexpensive to manufacture which extends the reach of a person.

It is another object of the present invention to provide a tool which is ideally constructed for enabling persons to open locked doors and gates.

These and other more specific objects and advantages of the invention will be apparent to those skilled in the art from the following detailed description taken in conjunction with the drawings.

BRIEF DESCRIPTION OF THE DRAWINGS

FIG. 5 is a cross-sectional side view illustrating a preferred embodiment of an arm of the present invention being extendable and retractable;

FIG. 6 illustrates a cross-sectional side view of a preferred tension member for use with the tool of the present invention;

FIG. 7 illustrates a cross-sectional side view of a preferred construction for a rotating member of the present invention; and, FIG. 8 is a cross-sectional side view illustrating a preferred construction for an outer fixed member for use with the tool of the present invention.

DETAILED DESCRIPTION OF THE INVENTION

Figure 1:
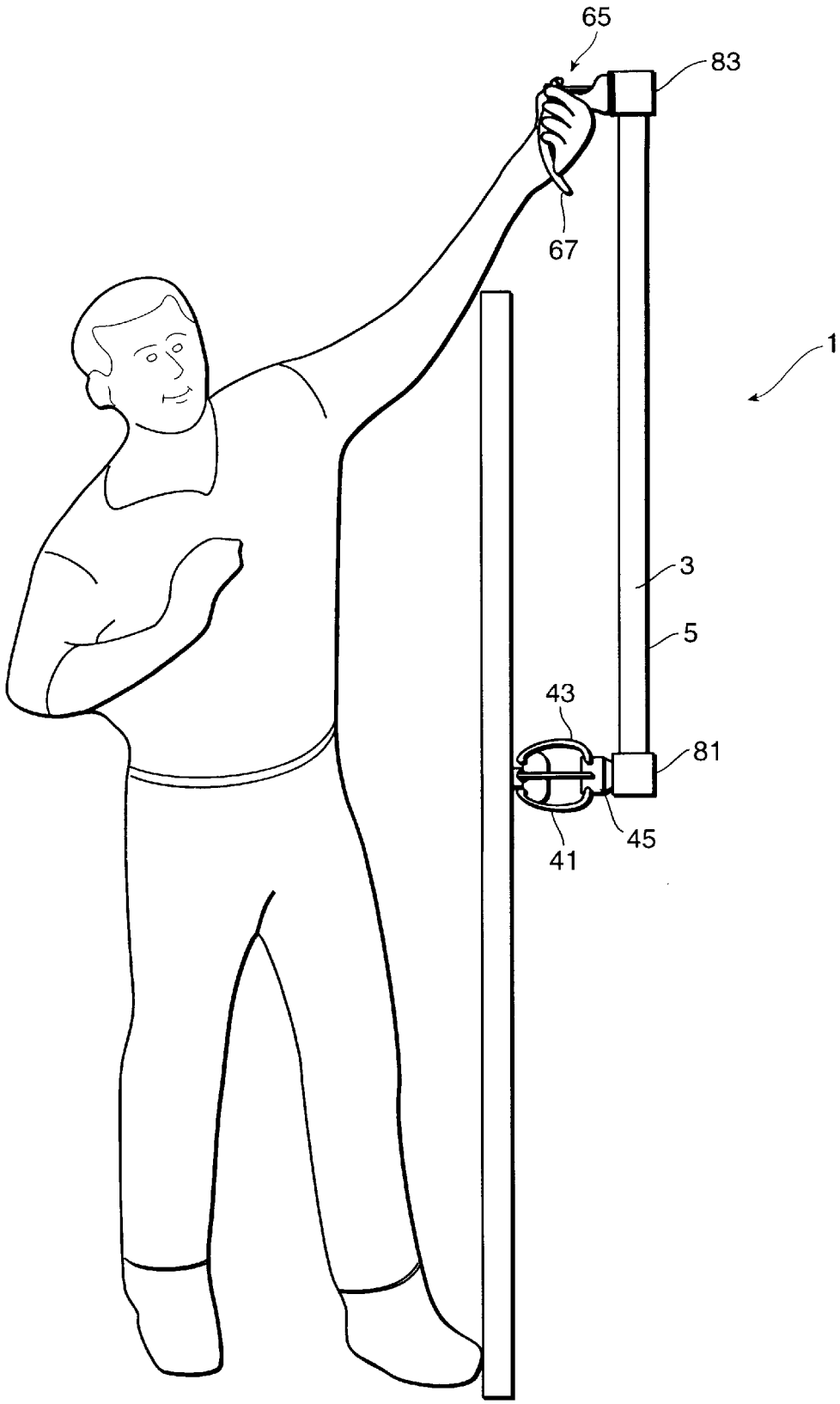
FIG. 1 is a perspective view illustrating a person utilizing the tool of the present invention for opening a locked door or gate.

While the present invention is susceptible of embodiment in various forms, as shown in the drawings, hereinafter will be described the presently preferred embodiments of the invention with the understanding that the present disclosure is to be considered as an exemplification of the invention, and it is not intended to limit the invention to the specific embodiments illustrated.

Figure 2:
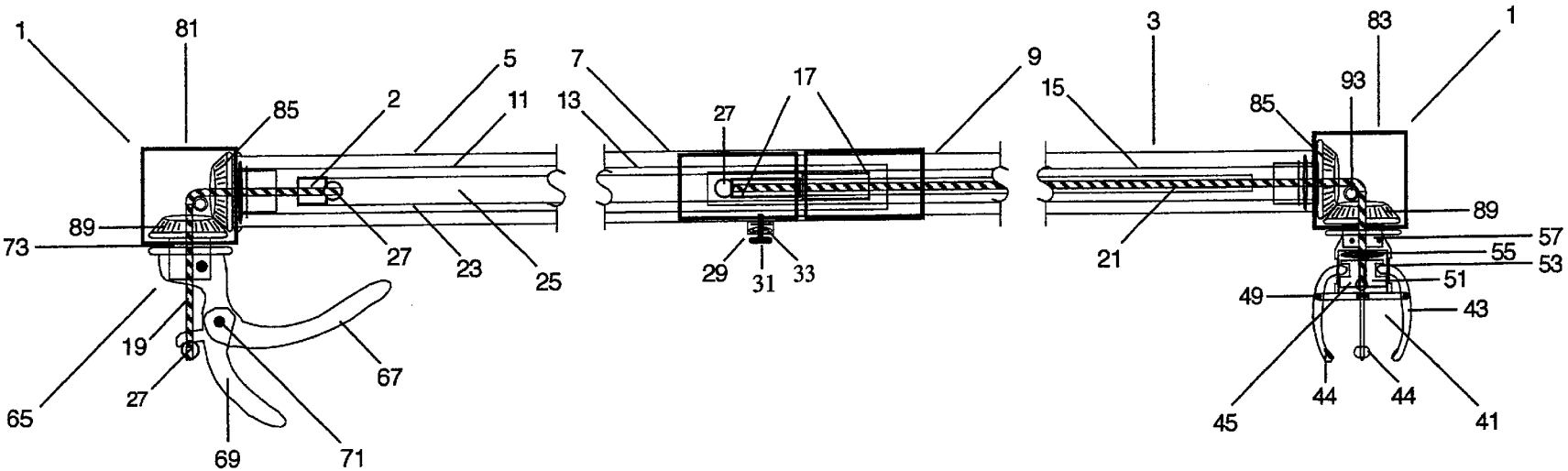
FIG. 2 is a cross-sectional side view illustrating the internal components of the tool of the present invention.
Figure 3:
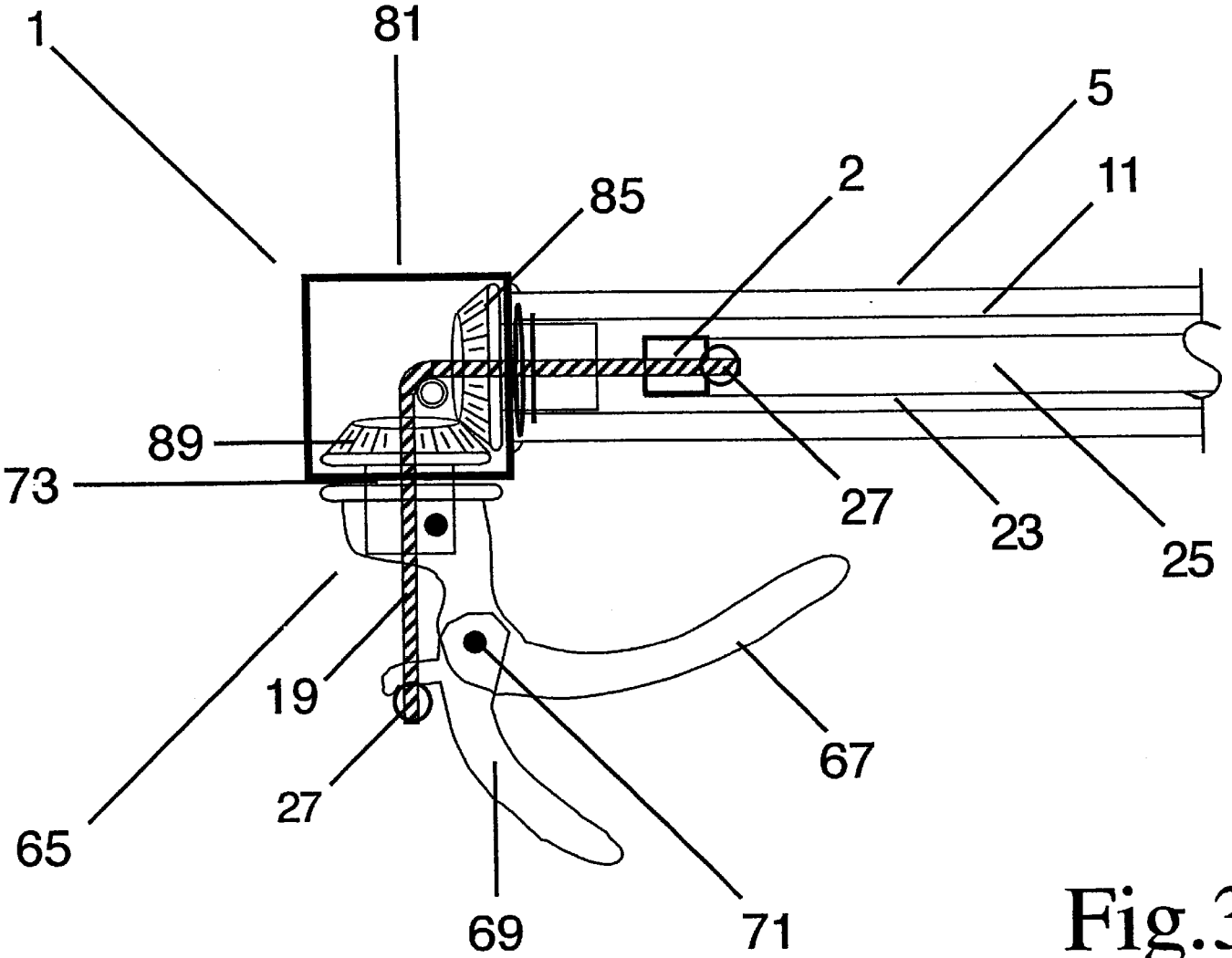
FIG. 3 is a blow-up cross-sectional side view illustrating the controller assembly and proximal extremity of the tool of the present invention.

As best shown in FIGS. 1–3, the tool I for extending the reach of a person of the present invention includes an elongate arm 3, a jaws assembly 41 and a controller assembly 65. The jaws assembly 41 and controller assembly 65 are affixed to the distal and proximal extremities of the arm 3, respectively. Both the jaws assembly and controller assembly may be affixed to the arm in various configurations. For example, the jaws assembly and controller assembly may project longitudinally from the ends of the arm. However, preferably and as shown in the figures, the jaws assembly 41 and controller assembly 65 extend parallel to one another and perpendicularly from the longitudinal axis of the tool's arm 3. As shown in FIG. 1, this construction is believed best for opening locked doors and gates.

Figure 4:
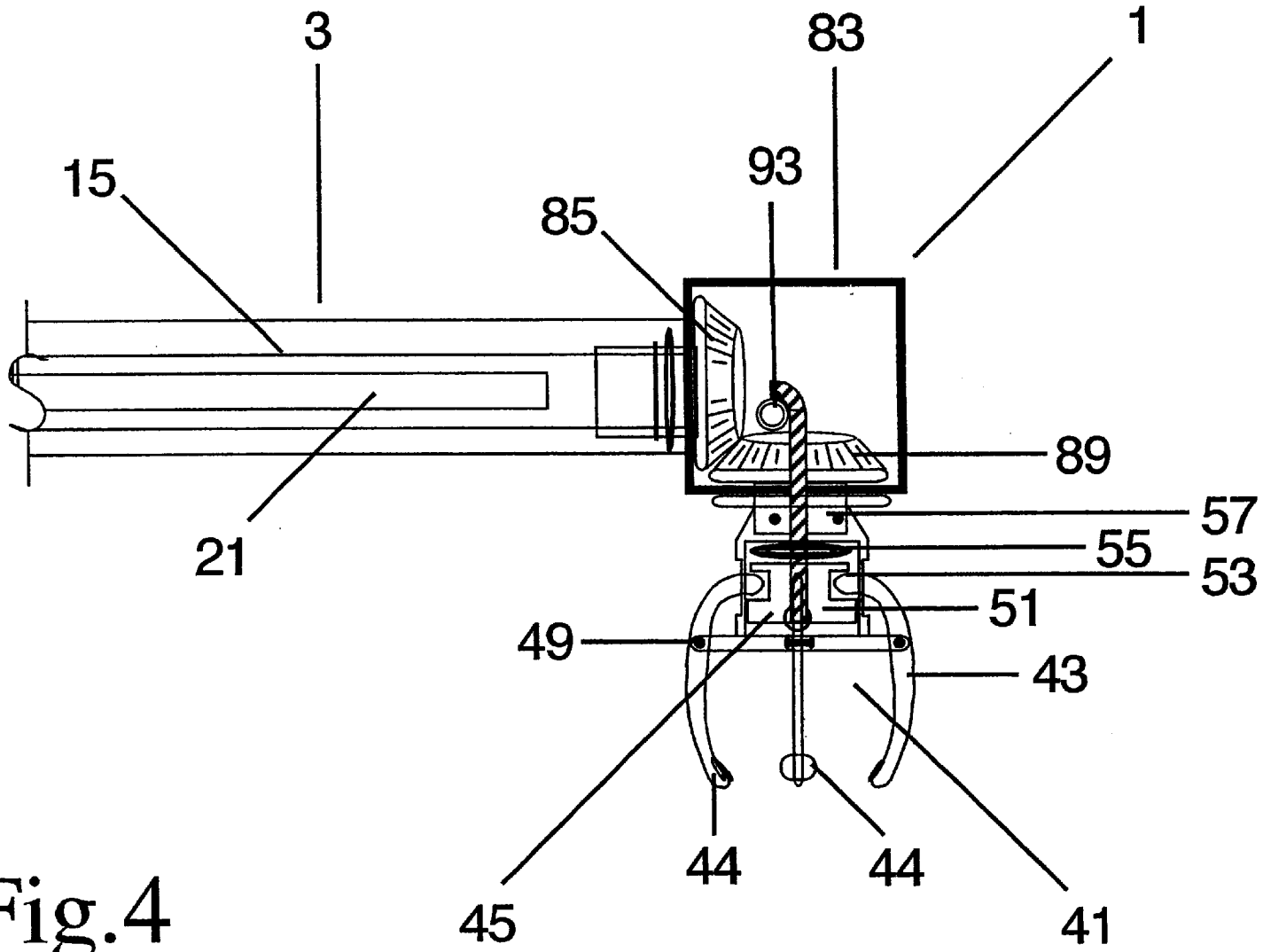
FIG. 4 is a blow-up cross-sectional side view of the jaws assembly and distal extremity of the tool of the present invention.

The jaws assembly may also be constructed in various forms. However, as shown in FIGS. 2 and 4, the jaws assembly 41 preferably includes a rotatable housing 45 and a plurality of jaws 43. The jaws 43 are pivotally attached to the housing by a central shaft that is connected to the bevel gear 89. Movement of the ends 44 of the jaws can be controlled by movement of the piston 51. In particular, outward movement of the piston, causes the piston to engage the proximal ends of the jaws forcing the jaw's proximal ends inwardly, and the distal ends 44 outwardly. Conversely, inward movement of the piston causes the jaws' proximal ends to be forced outwardly and the distal ends 44 to be forced inwardly, such as for grabbing of objects. As shown in the figures, the jaws assembly 41 includes a compression spring 55 for biasing the piston to an outward position so that when the tool is not being operated, the individual jaws are biased to an outward position.

Meanwhile, a preferred embodiment of the controller assembly 65 includes a first "rotation" controller for controlling the rotation of the jaws assembly, and a second "grappling" controller for controlling inward and outward movement of the jaws for the purpose of grappling or otherwise releasing objects. As shown in the figures, in a preferred embodiment, the controller assembly is constructed in the form of a handle 67 which attaches to the proximal extremity of the arm. As explained in greater detail below, rotation of the handle 67 causes the jaws assembly 41 to rotate.

As shown in FIGS. 2–4, the jaws assembly 41 and controller assembly 65 are attached to the arm 3 by junction boxes 81 and 83, respectively, having holes (not shown) in their sidewalls. The jaws assembly housing 45 projects through a hole in the junction box to engage a bevel gear 89. The jaws assembly is then rotatably affixed in place by a bearing or the like. Similarly, a portion of the handle 67 projects through a hole in the sidewall of the junction box 83 to engage a bevel gear 89. The handle is also rotatably affixed in place by a bearing or the like.

The tool's arm 3 includes a fixed outer tube 5 which extends from the control assembly's junction box 81 to the jaws assembly's junction box 83. Concentrically positioned within the fixed hollow tube 5 is an inner rotating member 11 which extends along the entire length of the arm within the outer tube's hollow region. Attached to the rotating member's proximal and distal extremities are bevel gears 85. The first bevel gear 85 is located within the controller assembly's junction box 81 and positioned to engage the handle's bevel gear 89. Similarly, the rotating member's second bevel gear 85 is located within the jaws assembly junction box 83, and positioned to engage the jaws assembly bevel gear 89. The handle 67, rotating member 11, and jaws assembly 65 are interconnected by the bevel gears 85 and 89 so that rotation of one causes the remainder to also rotate, thereby allowing a person to rotate the handle 67 to, in turn, rotate the jaws assembly 41 and plurality of jaws 43.

The tool 1 of the present invention further includes a tension member 17 extending from a lever 69 to the piston 51. The tension member 17 may be constructed of cord, or as an elongate rod, or as a combination of both. As shown in the figures, in a preferred embodiment, the tension member 17 is positioned within the interior of a hollow region of the rotating member and is constructed of a first cord 19, a tension rod 23, and a second cord 21. The first cord 19 engages the lever 69 and projects through holes formed in the handle 67, and bevel gears 89 and 85 to extend into the interior of the rotating member. The tension rod 23 attaches to the distal end of the first cord 19 and extends along a substantial portion of the rotating member 11 within its interior. Meanwhile, the second cord 21 connects the tension rod 23 to the piston 51. To this end, the second cord 21 engages the tension rod 23 and projects through holes formed within the centers of bevel gears 85 and 89, and through a hole formed in the housing 45 enabling the second cord 21 to engage the piston 51. The piston 51 is normally biased by compression springs to force the plurality of jaws outward. Tension applied to the tension member 17 by movement of the lever 69 causes the piston 51 to retract, thereby forcing the plurality of jaws inwardly so as to be capable of grabbing an object.

In a preferred embodiment, the tool's arm 3 is extendable and retractable. To accomplish this and as shown in FIGS. 5–8, the outer fixed tube 5 includes a telescopically arranged first outer tube segment 7 and second inner tube segment 9. The tubes 7 and 9 may be constructed in any number of shapes, including having a circular or square cross-section, as long as the second tube segment 9 has a sufficiently small inner diameter so as to allow the telescopically and rotating tube to reside within the interior of the second tube segment 9. Similarly, as shown in FIG. 7, the inner rotating member 11 also includes a first outer tubular segment 13 and a second inner tubular segment 15 which are arranged telescopically so that the inner segment 15 can slide within the outer segment 13. Preferably, the respective segments of the inner rotating tube 11 have a square cross-section so that torque and rotation can be effectively translated from one segment to another. Finally, the inner tension member 17 is constructed to collapse when the tool's arm 3 is retracted. In particular, the tension member's tension rod is hollow so that portions of cords 19 and 21 can project into the interior of the tension member when the arm 3 is retracted. Thus, the arm's outer fixed tube, inner rotating tube and tension member can each be collapsed to retract the tool's arm. Moreover, each of the individual components can be telescopically extended to extend the overall length of the tool's arm. Once extended, the arm's length is locked in place by a spring activated 33 locking pin 31 which projects through a hole formed in the side wall of the first and second segments of the outer fixed tube 5.

With reference to FIG. 1, to utilize the tool 1 of the present invention to open locked doors or gates, a person positions the tool through or over the top of a door or gate. The tool 1 is manipulated so that the plurality of jaws 43 are positioned around the gate or door's doorknob. A person manipulates the lever 69 so as to collapse the jaws upon the doorknob. Thereafter, the person rotates the handle 67 which in turn causes the jaws assembly 41 and doorknob to rotate, thereby unlocking the door or gate.

Although particular preferred embodiments of the present invention have been specifically described herein, it is to be understood that many variations may be made in the construction, materials and shape of the tool without departing from the spirit and scope of the invention. Having described my invention in such terms as to enable those skilled in the art to make and use it, and having identified the presently preferred embodiments thereof,

I claim:

1. A tool for extending the reach of a person, the tool comprising:

an arm having a proximal extremity, a distal extremity, and a longitudinal axis, said arm being hollow forming a central bore that extends the longitudinal length of said arm;

a hollow rotational member having a proximal extremity and a distal extremity, said rotational member being concentrically located within said bore of said hollow arm and capable of rotating relative to said arm;

a rotating jaws assembly including a plurality of jaws extending from the rotational member's distal extremity, said plurality of jaws also capable of being controllably forced inward or outward for grappling and releasing objects; and a distal pair of bevel gears connecting said rotational member to said plurality of jaws so that said jaws project from said arm's distal extremity, said distal pair of bevel gears having central bores;

a controller assembly including a rotating handle which projects from said arm's proximal extremity substantially perpendicular to said arm's longitudinal axis attached to said proximal extremity of said arm; said controller assembly also including a grappling lever for controlling inward and outward movement of said plurality of jaws, a proximal pair of bevel gears connecting said rotating handle to said rotational member so that said rotating handle projects from said arm's proximal extremity substantially perpendicular to said arm's longitudinal axis, said proximal pair of bevel gears having central bores, rotation of said rotating handle causing controllable corresponding rotation of said rotational member and said plurality of jaws; and a tension member for connecting said grappling lever to said plurality of jaws; said tension member engaging said grappling lever and said jaws so that movement of said grappling lever causes controllable corresponding inward and outward movement of said jaws, said tension member telescoping from said grappling lever, through said proximal bevel gears' bores, said rotational member's bore and said distal bevel gears' bores to connect to said plurality of jaws.

2. The tool of claim 1 wherein said arm is extendable and retractable.

3. The tool of claim 1 wherein said jaws project from said distal extremity of said arm substantially perpendicular to said arm's longitudinal axis.

* * * * *